US006372102B1

(12) United States Patent
Sakata et al.

(10) Patent No.: US 6,372,102 B1
(45) Date of Patent: Apr. 16, 2002

(54) METHOD FOR REDUCING CHARGE IN GAS DIFFUSING ELECTRODE AND ITS CHARGE REDUCING STRUCTURE

(75) Inventors: Akihiro Sakata, Tokyo; Koji Saiki, Osaka; Hiroaki Aikawa, Tokyo; Shinji Katayama, Okayama; Kenzo Yamaguchi, Tokyo, all of (JP)

(73) Assignees: Toagosei Co., Ltd.; Mitsui Chemicals, Inc., both of Tokyo; Kaneka Corporation, Osaka; Chlorine Engineers Corp., Ltd., Tokyo, all of (JP)

( * ) Notice: Subject to any disclaimer, the term of this patent is extended or adjusted under 35 U.S.C. 154(b) by 0 days.

(21) Appl. No.: 09/581,430

(22) PCT Filed: Oct. 12, 1999

(86) PCT No.: PCT/JP99/05620

§ 371 Date: Oct. 16, 2000

§ 102(e) Date: Oct. 16, 2000

(87) PCT Pub. No.: WO00/22192

PCT Pub. Date: Apr. 20, 2000

(30) Foreign Application Priority Data

| | | |
|---|---|---|
| Oct. 13, 1998 | (JP) | 10-290863 |
| Oct. 13, 1998 | (JP) | 10-290864 |
| Dec. 28, 1998 | (JP) | 10-373787 |

(51) Int. Cl.[7] ..... C25B 11/03
(52) U.S. Cl. ..... 204/283; 204/252
(58) Field of Search ..... 204/283, 252

(56) References Cited

U.S. PATENT DOCUMENTS

| | | | | |
|---|---|---|---|---|
| 4,436,608 A | | 3/1984 | Bennett et al. | 204/265 |
| 4,755,272 A | * | 7/1988 | Plowman | 204/283 |
| 5,013,414 A | * | 5/1991 | Morris et al. | 204/283 |
| 5,725,743 A | * | 3/1998 | Vaughan | 204/284 |
| 6,010,317 A | * | 1/2000 | Maget et al. | 204/283 |
| 6,060,196 A | * | 5/2000 | Gordon et al. | 204/283 |

FOREIGN PATENT DOCUMENTS

| | | |
|---|---|---|
| EP | 0 340 820 | 11/1989 |
| JP | 56-38485 | 4/1981 |

* cited by examiner

*Primary Examiner*—Bruce F. Bell
(74) *Attorney, Agent, or Firm*—Young & Thompson

(57) ABSTRACT

An electricity leading method for a gas diffusion electrode is provided, by which a gas diffusion electrode is easily fixed to a cathode current collecting frame, the contact part has reduced electrical resistance, even an electrically insulating mesh sheet can be utilized as a gas chamber, and only the gas diffusion electrode can be replaced in renewal of the electrode. The method includes preparing a gas diffusion electrode by sandwiching a conductor made of a highly conductive metallic mesh or spongy processed material in catalyst layers or attaching a catalyst layer onto the conductor while leaving the conductor exposed in the outer periphery of the electrode, and electrically connecting the exposed part of the conductor to a cathode chamber current collecting frame.

18 Claims, 6 Drawing Sheets

METHOD FOR REDUCING CHARGE IN GAS DIFFUSING ELECTRODE AND ITS CHARGE REDUCING STRUCTURE

This application is a 371 of PCT/JP99/05620 filed Oct. 12, 1999.

TECHNICAL FIELD

This invention relates to a method for attaching a gas diffusion electrode used as an oxygen cathode in sodium chloride electrolysis using an ion-exchange membrane and for leading electricity therefrom and to a structure for leading electricity.

BACKGROUND ART

Systems of leading electricity from a gas diffusion electrode to a cathode current collecting frame that have conventionally been used are roughly divided into the following two methods.

1) In Case of Sheet-shaped Gas Diffusion Electrode

The outer perimeter of a gas diffusion electrode is adjusted so that the gas diffusion electrode may slightly overlap with the gasket seal surface of a cathode chamber frame or a plate-shaped cathode current collecting frame (also called a cathode current collecting pan). A whole electrolytic cell is assembled by bringing the outer peripheral portion of the gas diffusion electrode and the gasket seal surface of the cathode chamber frame or the cathode current collecting pan into contact, setting a gasket thereon, and clamping, whereby the contact area is also clamped, and electricity is led from the gas diffusion electrode to the cathode current collecting frame via the thus clamped contact area.

2) In Case of Cathode Current Collecting Frame/gas Diffusion Electrode Integrated Body A sheet-shaped diffusion electrode is placed on a cathode current collecting frame having attached thereto a mesh (which has high electrical conductivity if made of a metal) for making a gas chamber in such a manner that the catalyst layer of the gas diffusion electrode may cover the surface of the mesh. The catalyst is sintered at a high temperature under a high pressure in a press to form a catalyst layer and, at the same time, to integrate the catalyst layer with the mesh for a gas chamber. Electricity is lead from the gas diffusion electrode directly to the cathode current collecting frame and the cathode chamber frame.

In either case, a flow of electricity from the cathode current collecting frame to the cathode chamber frame (cathode element) is secured by connecting the cathode current collecting frame and the cathode chamber frame by welding or by mechanically connecting using a volt or the like.

However, these conventional methods of attaching a gas diffusion electrode and of leading electricity involve the following problems attributed to the action and function.

1) Leading Electricity From the Outer Peripheral Portion of Gas Diffusion Electrode In the case of a small-sized electrolytic cell, a suitable conducting contact area can be secured with respect to the reaction area so that the contact current density can be reduced, and the electrical contact resistance can be reduced. In the case of a practical electrolytic cell having a reaction area of about 3 $m^2$, however, since a suitable conducting contact area cannot be secured with respect to that reaction area, the contact current density is increased, and the electrical contact resistance is increased. Further, in a large-sized electrolytic cell of which the side of the reaction area is 1 m or longer, the structural resistance of the conductor in the gas diffusion electrode becomes high. From these facts, operating economy is inferior. In addition, where the gas diffusion electrode has small strength, it may be fractured at the part pressed by the gasket, and oxygen and a caustic soda solution leak from the fractured part.

2) Integration of Gas Diffusion Electrode, Mesh Sheet and Cathode Current Collecting Frame A practical electrolytic cell has a reaction area of about 3 $m^2$. In order to integrate the gas diffusion electrode, the mesh sheet and the cathode current collecting frame, a huge pressing machine, a huge mold, and a huge heating apparatus are needed, which is not economical. The cathode current collecting frame is liable to thermal deformation upon pressing at a high temperature, meeting great difficulty in securing flatness precision. Supposing these members could be integrated with good precision, the integrated cathode current collecting frame whose reaction area is as large as 3 $m^2$ is mechanically weak, i.e., so flimsy that it is extremely hard to handle in transporting from a pressing factory to the place of installation of the electrolytic cell. This problem is common to the above-described case of "leading electricity from the outer peripheral portion of gas diffusion electrode".

In renewing the gas diffusion electrode, it is difficult to detach the gas diffusion electrode from the cathode current collecting frame. Therefore, the cathode current collecting frame and the mesh sheet must be exchanged in the renewal of the gas diffusion electrode, which is uneconomical.

In the case of a practical electrolytic cell whose reaction area is as large as about 3 $m^2$, a huge pressing machine and a huge pressing mold are required for integrating the gas diffusion electrode with the cathode current collecting frame.

DISCLOSURE OF THE INVENTION

The present invention has been made in the light of the above-mentioned problems in conventional techniques. It is an object of the invention to provide a method of attaching a gas diffusion electrode and of leading electricity and to provide a structure for leading electricity, which fulfill the following six requirements.

1. To reduce the sized of a unit gas diffusion electrode to make production and handling easier.

2. To diminish the resistance of a structure of the gas diffusion electrode itself by the size reduction of the gas diffusion electrode.

3. To make it easy to attach the gas diffusion electrode to the cathode current collecting frame while reducing the electrical resistance of the connecting part.

4. To make a structure allowing only the gas electrode to be detached in renewal of the electrode.

5. To make a structure for leading electricity which allows the cathode current collecting frame and the cathode chamber frame to easily be assembled together and separated apart and also which minimizes the electrical resistance of a structure at the cathode current collecting frame.

6. To make it possible, taking advantage of the separability, to carry out an integrating operation even in the production of a current collecting frame/gas diffusion electrode integrated body by using an exclusive tool which structurally withstands pressing, and yet to remove the gas diffusion electrode together with a conducting rib in renewing the gas diffusion electrode while leaving the cathode chamber frame re-useful.

The present inventors have conducted extensive studies in order to solve the above-described problems. As a result, they have found that the above problems can be overcome by interposing a conductor comprising a metallic mesh or spongy processed material between catalyst layers or attaching a catalyst layer onto the conductor to make a gas diffusion electrode allowing the conductor having excellent conductivity to be exposed only at the outer peripheral portion thereof, and fixing the exposed metallic conductor to a cathode current collecting frame, which functions as a medium for leading electricity from the gas diffusion electrode to a cathode chamber frame, either by welding (such as spot welding or laser welding) or by inserting a wedge into a groove made at a prescribed position of the cathode current collecting frame.

It has also been found that the above objects are accomplished by attaching a conducting rib to the back of the cathode current collecting frame of the gas diffusion electrode, attaching a conducting receptacle to the cathode chamber frame of the gas diffusion electrode of an electrolytic cell at the positions mating the conducting rib of the back of the current collecting frame, and fitting the conducting rib on the back into the receptacle. The present invention has been completed based on these findings.

That is, the present invention includes the following aspects.

The present invention relates to a method for leading electricity from a gas diffusion electrode, in which a part through which electricity is led to a cathode element is constructed by providing a conductor having excellent conductivity and comprising a metallic mesh or spongy processed material, which conductor is sandwiched between catalyst layers except for the outer peripheral portion thereof or onto which conductor a catalyst layer is provided so that the conductor is exposed only at the outer peripheral portion of the thus-prepared gas diffusion electrode, and electrically connecting the exposed part of the conductor to a cathode chamber current collecting frame.

The present invention relates to the above-described method for leading electricity from a gas diffusion electrode, wherein the exposed part of the conductor is fixed by welding to the cathode current collecting frame acting as a conductor to a cathode chamber frame.

The present invention relates to the above-described method for leading electricity from a gas diffusion electrode, wherein the welding of the exposed outer periphery of the conductor to the cathode current collecting frame is carried out by applying a metallic cover material having excellent conductivity on the conductor to protect the conductor from damage during welding.

The present invention relates to the above-described method for leading electricity from a gas diffusion electrode, wherein a gap between gas diffusion electrodes where the exposed outer peripheries of the conductors are welded is sealed with a sealant to prevent a caustic soda solution from entering.

The present invention relates to the above-described method for leading electricity from a gas diffusion electrode, wherein the cathode current collecting frame has a groove projecting from a gas chamber side toward the cathode element side at a prescribed position, the exposed part of the conductor is inserted into the groove, and then a wedge is inserted therein to connect the gas diffusion electrode to the cathode current collecting frame.

The present invention relates to the above-described method for leading electricity from the gas diffusion electrode, wherein the sealant which is applied to the space above the wedge to prevent a caustic soda solution from entering through the gap comprises the same material as the catalyst layer of the gas diffusion electrodes.

The present invention relates to an electricity leading structure of a gas diffusion electrode, wherein a cathode current collecting frame forms a partition dividing a gas chamber on the gas chamber side of the gas diffusion electrode and has a conducting rib projecting outward on its back for leading electricity.

The present invention relates to the above-described electricity leading structure of a gas diffusion electrode, wherein a cathode chamber frame is a conductor and has a receptacle made of copper or brass at a position mating with the above-described conducting rib on the back of the cathode current collecting frame.

The present invention relates to an electrolytic cell having an electricity leading structure that is easily assembled and disassembled by inserting the above-described conducting rib on the back of the cathode current collecting frame into the above-described receptacle for the cathode chamber frame.

Alkali-resistant and highly conductive metals which are worked into a metallic mesh or spongy processed material which can be used as a conductor in the present invention include platinum, gold, silver, nickel, and the like. Silver and nickel are preferred from the standpoint of economy, and silver is the most preferred for its excellent conductivity.

In the present invention, the welding means for fixing the exposed outer periphery of the gas diffusion electrode to the cathode current collecting frame include spot welding, laser welding, and the like. Electricity can flow from the gas diffusion electrode to the cathode current collecting frame through the weld joint. The weld line should not cross the flow of gas supplied to the gas diffusion electrodes. If it crosses the gas flow, it will hinder the gas flow in the gas chamber. Gas is usually made to flow downward in the gas chamber (i.e., interstices in a mesh sheet), the weld line is vertical.

In the present invention, a mesh sheet of the gas chamber on the inner side of the gas diffusion electrode can be fixed by welding the gas diffusion electrode. This method is not significance so much where the mesh sheet is metallic, because it is possible to fix the mesh sheet to the cathode current collecting frame by welding, such as spot welding, laser welding, etc. Where the mesh sheet is made of a resin, fixing by welding is difficult. Further, since a resin-made mesh sheet is lightweight, the above-described method of fixing the gas diffusion electrode by welding is effective to stabilize the mesh sheet.

When the outer peripheral exposed conductor of the gas diffusion electrode is fixed to the cathode current collecting frame by welding according to the invention, it is preferred to put a cover material, such as a rod or thin sheet of metal, e.g., nickel, on the conductor in order to prevent damage to the conductor during welding.

Sealants which can be used in the present invention to seal the gap between adjacent gas diffusion electrodes, i.e., the upper part of the weld of the conductor or the upper part of wedge fixing the conductor to the cathode current collecting frame hereinafter described, for prevention of a caustic soda solution's entering is not particularly limited, and any alkali-resistant sealant can be used. For example, high-performance sealants, such as synthetic rubber, synthetic resins, particularly modified silicone resins and thiocholic resins are preferably used.

The longitudinal size of the gas diffusion electrode can be equal to the height of the electrolytic cell. The transverse size is preferably in a range of from 400 to 300 mm, taking into consideration the structural resistance of the conductor of the gas diffusion electrode and ease in production and handling of the gas diffusion electrode. Accordingly, a plurality of unit gas diffusion electrodes having such a small width are connected to each other to construct the cathode of the electrolytic cell with ease.

In renewing the gas diffusion electrode, only the gas diffusion electrode can be replaced by cutting the outer peripheral exposed conductor of the gas diffusion electrode. There is no need to remove the whole cathode chamber frame. Exchange of electrodes can then be carried out by fixing a new gas diffusion electrode to the cathode current collecting frame by welding.

It is preferred that the cathode current collecting frame be in a plate shape so that it serves as a partition for making a gas chamber for the gas diffusion electrode. While having a plate shape, the current collecting frame desirably has a recess to provide a gas chamber. A current collecting mesh serving as a gas chamber spacer is provided on the gas diffusion electrode side of the cathode current collecting frame thereby to provide a gas chamber between the gas diffusion electrode and the cathode current collecting frame. The cathode current collecting frame has a conducting rib for leading electricity. Any metal having excellent conductivity can be used as a conductive material for the conducting rib with no particular restriction. From the economical consideration, copper or brass is preferred, which is the same as the material of the receptacle.

BEST MODE FOR CARRYING OUT THE INVENTION

Examples of the present invention will be explained based on the drawings, but the invention should not be construed as being limited thereto.

EXAMPLE 1

Figure 1:
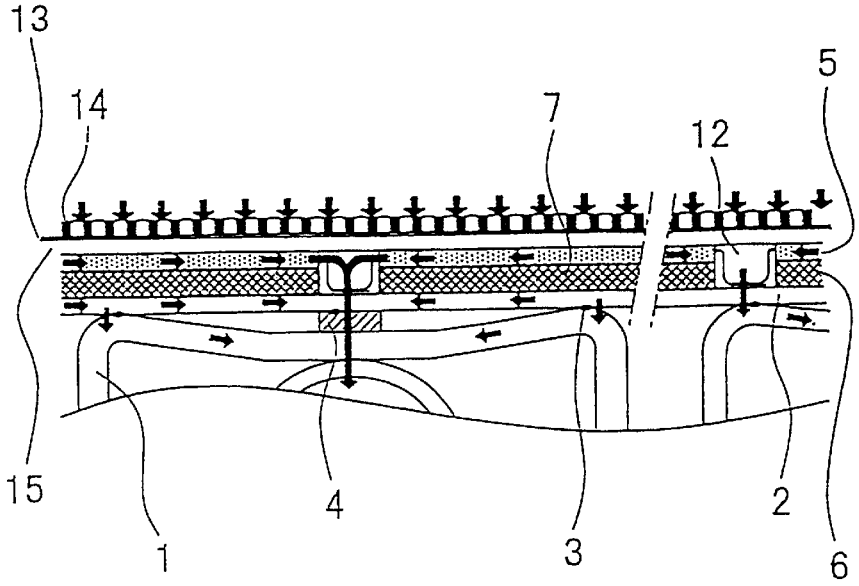
FIG. 1 is a crosssectional illustration showing an example of the method of fixing a gas diffusion electrode by welding and of leading electricity according to the present invention.

An example of the method of attaching a gas diffusion electrode and leading electricity according to the present invention is generally described by way of FIG. 1.

In FIG. 1, a nickel-made cathode current collecting frame 2 is fixed to a cathode chamber frame conductor 1 at welds 3. The welding here is spot welding. Mesh sheets 6 are placed on the cathode current collecting frame 2 to secure the space for oxygen gas feed. The interstices in the mesh form a gas chamber 7 between the cathode collecting frame 2 and the gas diffusion electrode 5. The mesh sheet 6 may be made either of metal or a resin. The gas diffusion electrode 5 is made by interposing a metallic mesh processed material, for example, a silver mesh, which becomes a conductor 9 in between catalyst layers 10 or attaching the mesh to one side of a catalyst layer 10 (see FIG. 4).

The conductor 9 in the outer peripheral portion of the gas diffusion electrode 5 is exposed around the outer periphery of the catalyst layer(s) 10. The exposed part is bent at the outer peripheral edge of the catalyst layer(s) 10 to form gaps 8 between adjacent gas diffusion electrodes at given intervals (see FIG. 3). The exposed edge of another conductor 9 of the adjacent gas diffusion electrode 5 is similarly bent into the gap 8, overlapped, and fixed by welding (such a structure will be described later in more detail with reference to FIGS. 4 to 7). The space in the gap 8 above the conductors 9 inserted and overlapped is sealed with an alkali-resistant sealant 12. Weld fixing of the gas diffusion electrodes 5 and electricity leading are thus completed. Numerals 13, 14 and 15 indicate an ion-exchange membrane, an anode, and a caustic chamber where a caustic soda solution flows, respectively. The arrows represent the flow of electricity.

The above-described method of weld fixing a gas diffusion electrode and leading electricity according to the invention will be described in the order of steps by way of FIGS. 2 through 7.

Figure 2:
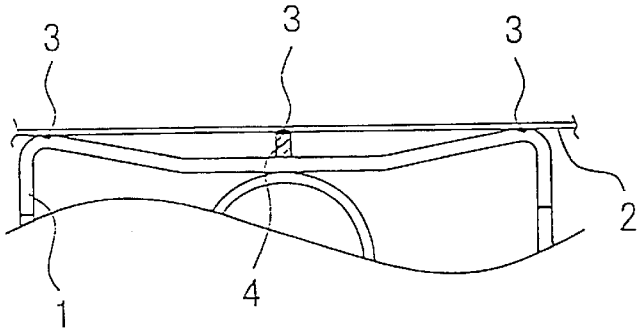
FIG. 2 is a crosssectional illustration showing the step of spot welding a cathode current collecting frame and a cathode chamber frame conductor in the method of fixing a gas diffusion electrode by welding and of leading electricity according to the present invention.

First of all, a nickel-made cathode current collecting frame 2 is spot welded to a cathode chamber frame conductor 1 of an electrolytic cell at welds 3 as shown in FIG. 2. In order to reduce the structural resistance, a conducting rib 4 may be provided, and the frame 2 is welded thereto (weld 3).

Figure 3:
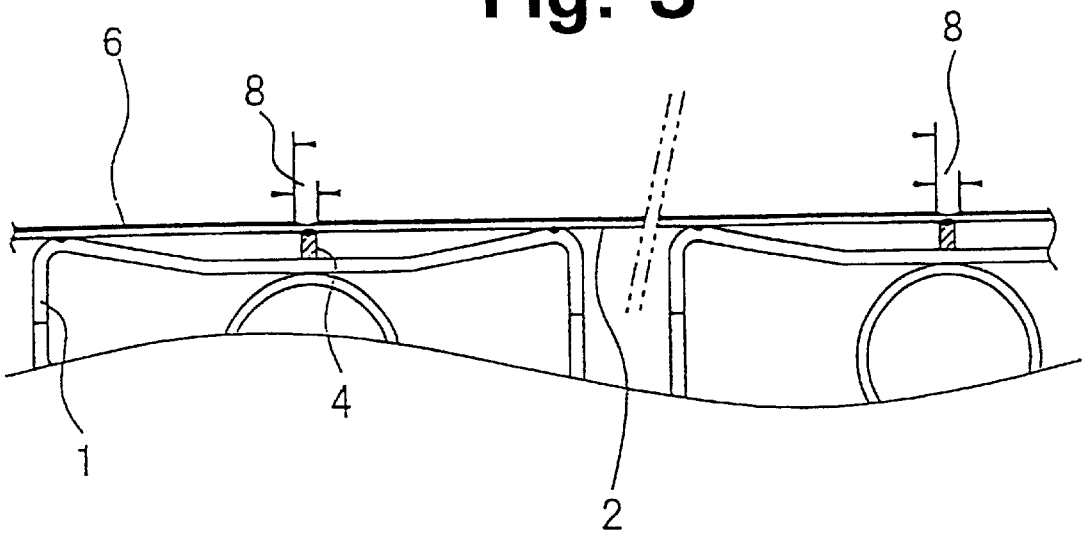
FIG. 3 is a crosssectional illustration showing the step of placing a mesh sheet on the cathode current collecting frame to form a gas chamber.

As illustrated in FIG. 3, mesh sheets 6 are put on the cathode current collecting frame 2 in order to secure a space for supplying gas to the gas diffusion electrode 5. The mesh to be used includes a nickel-made mesh shaped into a wavy form, i.e., a so-called corrugated mesh, and the like. The space formed by the mesh-sheet 6 becomes a gas chamber (a space where gas passes by) 7. The mesh sheet 6 can be made of either metal or a resin. The mesh sheet 6 is laid not all over the cathode current collecting frame 2 but with gaps 8 of about 1 to 5 mm at prescribed intervals. The gaps 8 are preferably positioned at the conducting ribs 4. The interval between the gaps 8 is preferably about 300 to 400 mm, taking into consideration the structural resistance of the conductor 9 in the gas diffusion electrode 5 and the workability in attaching the gas diffusion electrodes 5. While the mesh sheets 6 can merely be put on the cathode current collecting frame 2, they may be fixed by welding (e.g., laser welding, spot welding, etc.) or with an adhesive, etc. for preventing a slip.

Figure 4:
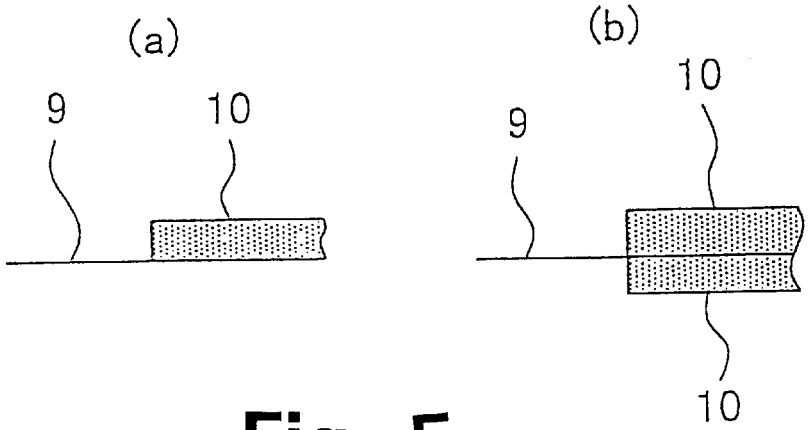
FIGS. 4 are crosssectional illustrations representing the structure of the gas diffusion electrode according to the present invention, in which (*a*) shows the one having a catalyst layer on one side of a conductor, and (*b*) depicts the one having the conductor sandwiched in between catalyst layers.

Separately, gas diffusion electrodes 5 are prepared by interposing a conductor 9 in between catalyst layers 10 or attaching a conductor 9 to one side of a catalyst layer 10 as shown in FIG. 4. The conductor 9 is exposed around the gas diffusion electrode 5 as shown in FIGS. 4(*a*) and 4(*b*). The conductor is fabricated of a metallic mesh processed material, such as a silver mesh or a nickel mesh, or a metallic spongy processed material, such as blowing nickel.

Figure 5:
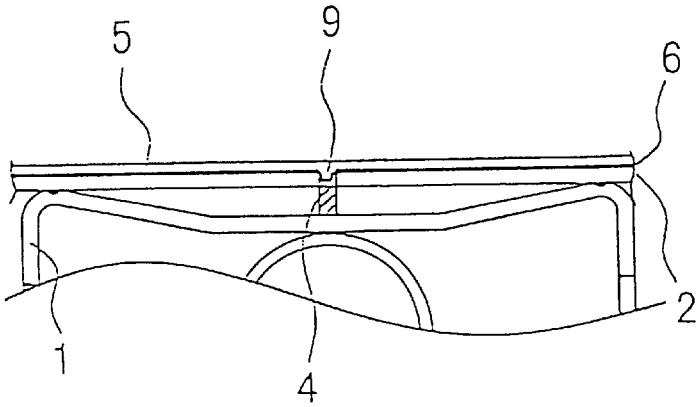
FIG. 5 is a crosssectional illustration showing the step of overlapping bent parts of the outer peripheral exposed edges of the conductors of adjacent gas diffusion electrodes.
Figure 6:
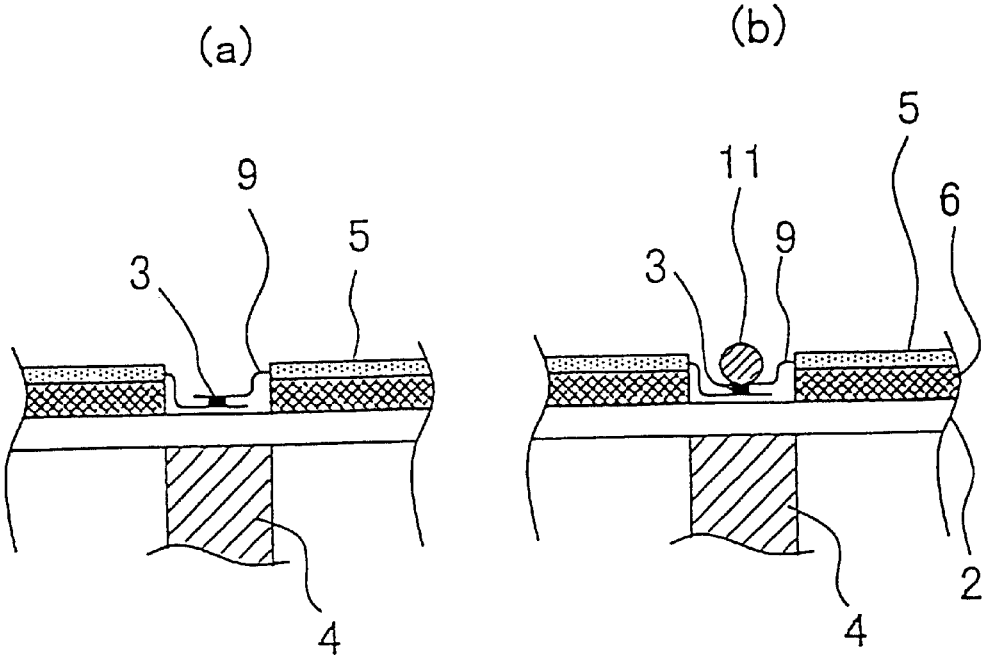
FIGS. 6 are enlarged crosssectional illustrations showing the step of welding the overlap of the exposed edges of the conductors shown in FIG. 5, in which (*a*) shows the case of using no cover material, and (*b*) the case of using a cover material.

As illustrated in FIGS. 5 and 6 the gas diffusion electrodes 5 are put on the cathode current collecting frame 2 and the mesh sheets 6 for gas chambers 7 in such a manner that the outer peripheral conductor 9 of each gas diffusion electrodes 5 may be positioned at the gap 8 between the mesh sheets 6 (about 1 to 5 mm wide). The exposed conductors 9 of adjacent gas diffusion electrodes 5 are overlapped with each other and fixed to the cathode current collecting frame 2 by spot welding or laser welding or a like welding technique (weld 3). While not always necessary, it is recommended to overlap the conductors 9 with each other to reduce the number of welded joints. In carrying out welding 3, a cover material 11, such as a thin plate or a rod of silver, nickel, etc. may be put on the conductors 9 so that welding may be effected via the cover material so as to protect the very thin conductors 9 (about 0.2 mm thick) from damage. After welding 3, the cover material 11 does not need to be removed (see FIGS. 6(*a*) and 6(*b*)).

Figure 7:
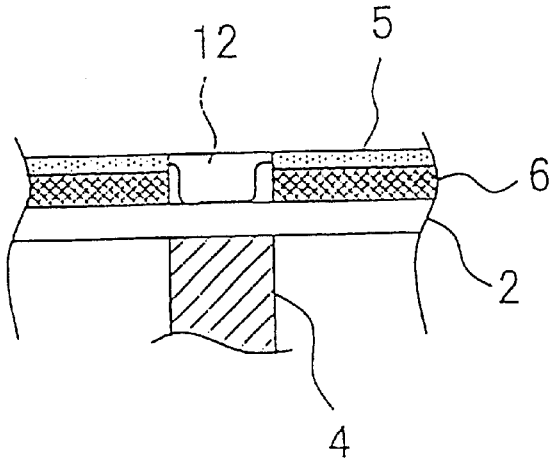
FIG. 7 is an enlarged crosssectional illustration showing the step of sealing following the step of welding in FIG. 6(*a*).

The gaps 8 between the gas diffusion electrodes are then sealed with an alkali-resistant sealant 12 as shown in FIG. 7. Alternatively, it is desirable that the catalyst resin for the gas diffusion electrode be applied to the gap 8, heated, and pressed to be integrated with the gas diffusion electrode 5. If there is the cover material 11, then the amount of the sealant 12 to be applied decreases, and the cover material 11 acts to fix the sealant 12. Therefore, it is preferred to use the cover material 11.

In this way, electricity coming from the anode 14 through the ion-exchange membrane 13 passes through caustic soda flowing in the caustic chamber 15, the gas diffusion electrodes 5, and the conductors 9 of the gas diffusion electrodes 5. From the edges of the conductors 9, electricity flows to the cathode current collecting frame 2 and finally reaches the cathode chamber frame conductor 1.

Test Example 1

A test was conducted using an electrolytic cell having the following specifications under the following running conditions. As a result, electrolysis could be accomplished at such a considerably low voltage as 2.00 V. Dimensions of reaction plane: 100 mm wide by 600 mm high (reaction area: 6 $dm^2$)

Anode: DSE, available from Permelec Electrode Ltd.

Cathode: gas diffusion electrodes (two sheet electrodes 50 mm wide by 600 mm high were fixed by welding)

Mesh sheet: nickel-made corrugated mesh (nickel-made mesh shaped into a wavy form)

Ion-exchange membrane: Flemion 893, available from Asahi Glass Co., Ltd.

Electrolytic current density: 3 $kA/m^2$

Running temperature: 90° C.

Caustic concentration: 32 wt % NaOH

Brine concentration: 210 g-NaCl/liter

EXAMPLE 2

Figure 8:
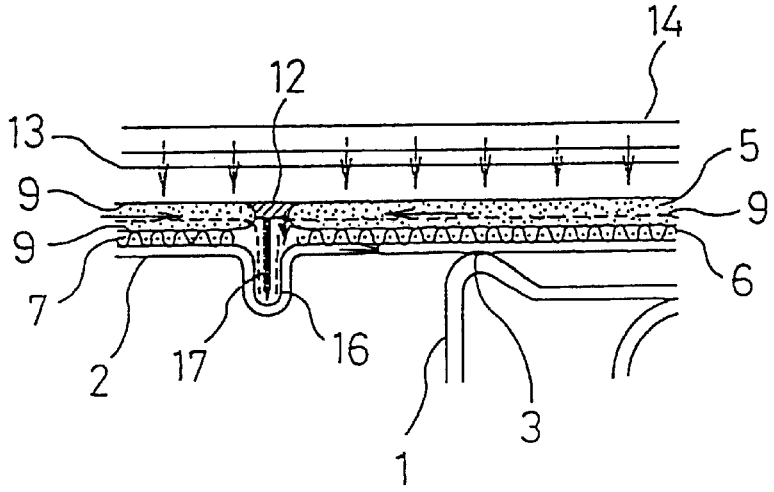
FIG. 8 is a crosssectional illustration showing an example of the method of attaching a gas diffusion electrode and of leading electricity according to the present invention.

FIG. 8 is a partial transverse section of an electrolytic cell having the gas diffusion electrodes of the invention. The cathode current collecting frame 2 has a flat plate shape and has a groove 16 formed by press working at a prescribed position, the groove 16 projecting from the gas chamber 7 side toward the cathode element side. Seeing that FIG. 8 is a transverse section, the groove 16 extends vertically.

A conventional cathode current collecting frame is shaped in the form of a plate and has a recess in the middle like a frying pan, and is therefore called a cathode current collecting pan. Since the member 2 used in this invention is a flat plate serving for cathode current collection, it is called a "cathode current collecting frame" as conventionally called.

Similarly to Example 1, a conductor 9 exposed in the outer peripheral portion of the gas diffusion electrode 5 is bent from the outer perimeter of the catalyst layers 10 and inserted in the projected groove 16. In this groove 16 is also inserted a bent outer peripheral exposed edge (also referred to as an exposed part) of the conductor 9 of the adjacent gas diffusion electrode 5. A metal-made, preferably nickel-made wedge 17 is further inserted between the conductors 9 inserted in the groove 16 to strongly press each conductor 9 in contact with the inner wall of the groove 16 of the cathode current collecting frame 2. The space above the wedge 17 is sealed with an alkali-resistant sealant 12 so as to prevent the caustic soda solution from entering. Attachment of the gas diffusion electrodes 5 and electricity leading therefrom are thus completed. Numerals 13 and 14 indicate an ion-exchange membrane (IEM) and an anode, respectively.

Figure 9:
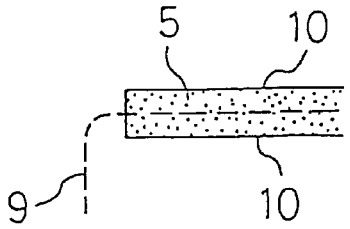
FIG. 9 is a crosssectional illustration showing the constitution of a gas diffusion electrode according to the present invention.

As shown in FIG. 9, a conductor 9 is sandwiched in between catalyst layers 10 to make a gas diffusion electrode 5. The edges of the conductor 9 are exposed at the outer periphery of the gas diffusion electrode 5 and bent at the edges of the catalyst layers 10. The width of each gas diffusion electrode 5 corresponds to the interval of the grooves 16 of the cathode current collecting frame 2. The length of the exposed edge of the conductor 9 from the bend is approximately equal to the depth of the groove 16.

Figure 10:
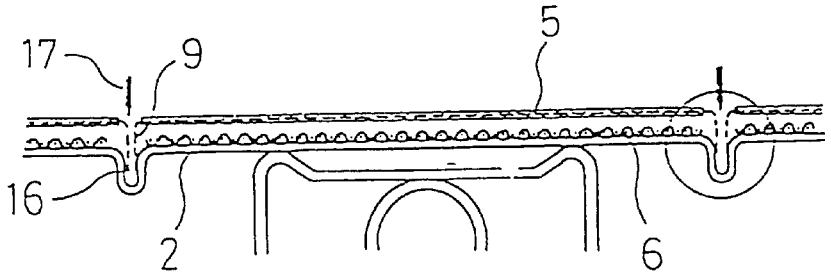
FIG. 10 is a crosssectional illustration showing the step of inserting bent edges of each conductor in the outer periphery of gas diffusion electrodes into grooves of a cathode current collecting pan and the subsequent step of inserting wedges into the grooves.

Subsequently, the above-described gas diffusion electrodes 5 are put on the cathode current collecting frame 2 and the mesh sheets 6 forming gas chambers, and both bent edges of each conductor 9 in the outer periphery of the gas diffusion electrode are inserted into the respective grooves 16 of the cathode current collecting pan as shown in FIG. 10. A wedge 17 is then inserted between the edges of the conductors 9 inserted in the groove 16 to strongly press and bring each conductor 9 into contact with the inner wall of the groove 16 of the cathode current collecting frame 2.

Figure 11:
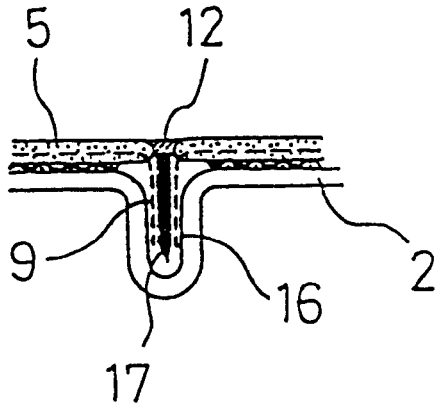
FIG. 11 is an enlarged crosssectional illustration showing an example of the step of the insertion of a wedge into a groove and the step of sealing.

The space above the wedge 17 is sealed with an alkali-resistant sealant as shown in FIG. 11. It is desirable that the same catalyst as used in the gas diffusion electrode be applied thereto, heated, and pressed to be integrated with the gas diffusion electrode 5. An electrolytic solution's entering the gas chamber and gas escape from the gas chamber are thus prevented.

Figure 12:
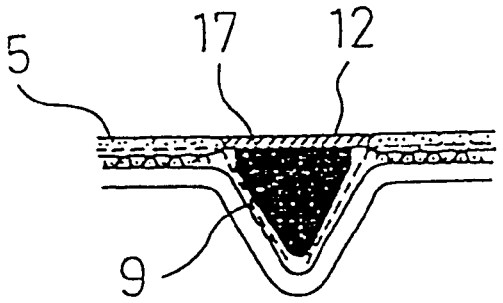
FIG. 12 is an enlarged crosssectional illustration showing another example of the step of the insertion of a wedge into a groove and the step of sealing.

The shape of the groove 16 of the cathode current collecting frame 2 and the shape and material of the wedge 17 include not only those described above but the embodiment shown in FIG. 12, in which the groove 16 has an inverted triangular shape with its base open, and the wedge 17 has a triangular shape and is made of polytetrafluoroethylene (PTFE). In this case, PTFE expands at a running temperature to exert an increased pressing force onto the conductor 9 of the gas diffusion electrode and the cathode current collecting frame 2.

Other groove shapes are also within the scope of the invention.

Test Example 2

A test was performed using an electrolytic cell having the following specifications under the following running conditions. As a result, electrolysis could be accomplished at such a considerably low voltage as 2.10 V. Dimensions of reaction plane: 100 mm by 600 mm (reaction area: 6 $dm^2$)
Anode: DSE, available from Permelec Electrode Ltd.
Cathode: gas diffusion electrodes
Ion-exchange membrane: Flemion 893, available from Asahi Glass Co., Ltd.
Electrolytic current density: 3 $kA/m^2$
Running temperature: 90° C.
Caustic concentration: 32 wt % NaOH
Brine concentration: 210 g-NaCl/liter

EXAMPLE 3

Figure 13:
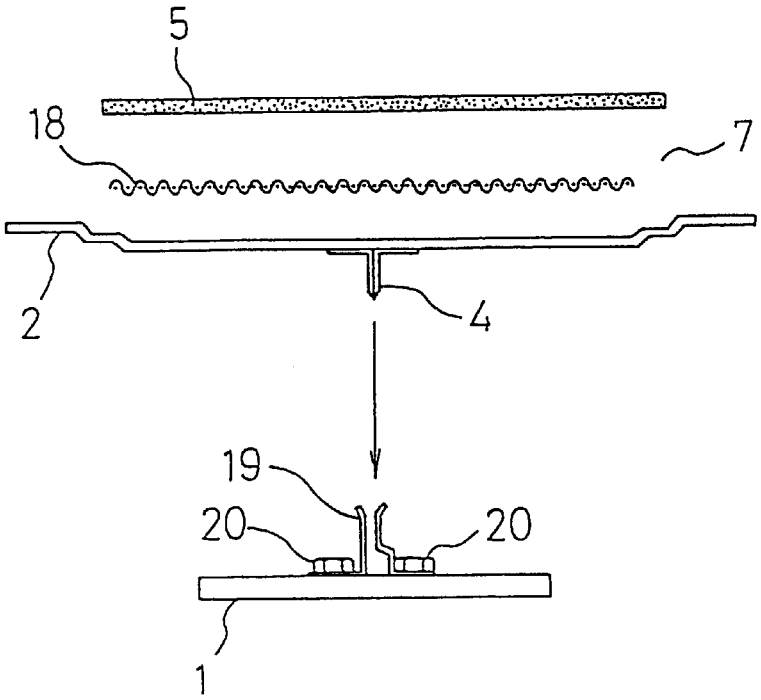
FIG. 13 is a crosssectional illustration showing an example of the structure for attaching a gas diffusion electrode and the leading electricity according to the present invention.

FIG. 13 illustrates only the structure for the attachment of the gas diffusion electrode and for electricity leading according to the present invention. Since FIG. 13 is a section transversely taken of the structure for the attachment and the electricity leading, all the elements such as gas diffusion electrode 5, the cathode chamber frame conductor 1 and so forth are set up in a vertical direction perpendicular to the paper plane.

In FIG. 13, a current collecting mesh 18 functioning as a gas chamber spacer for securing the space for supplying oxygen gas is set on the recess of the cathode current collecting frame 2 to provide a gas chamber 7 between the gas diffusion electrode 5 and the frame 2. To the back side of the recess of the cathode current collecting frame 2 is attached a conducting rib 4 sticking outward for leading electricity.

On the other hand, a metallic receptacle 19 is fitted to the surface of the cathode chamber frame conductor 1 at the position mating the conducting rib 4 attached to the back of the cathode current collecting frame 2 by means of bolts 20. Both the conducting rib 4 and the receptacle 19 are preferably made of brass from the standpoint of conductivity and economy.

Figure 14:
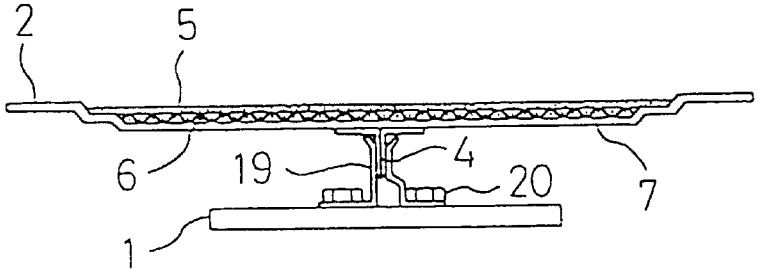
FIG. 14 is a crosssectional illustration showing an assembled state of the electricity leading structure according to the present invention.

FIG. 14 is a cross section showing the assembled state of an electrolytic cell having the gas diffusion electrode, in which the back side rib 4 of the cathode current collecting frame 2 is inserted into the receptacle 19 of the cathode chamber frame conductor 1. In this way the cathode current collecting frame 2 and the cathode chamber frame 1 can easily be combined together simply by inserting the back side conducting rib 4 into the receptacle 19. Since FIG. 14 is a transverse section, it represents the view of the transversely cut area seen downward so that the cathode current collecting frame 2 and the other elements are not facing up in the paper plane.

Thus, electricity flowing from the anode through the ion-exchange membrane (both now shown) passes through the gas diffusion electrode 5, the mesh 18, the cathode current collecting frame 2, the conducting rib 4, the receptacle 19 and finally to the cathode chamber frame conductor 1. In disassembling, the gas diffusion electrode can easily be detached simply by pulling the conducting rib 4 from the receptacle 19. The receptacle 19 can be fitted freely and firmly to the cathode chamber frame 1 independently of, and with no interference by, the cathode current collecting frame 2.

Test Example 3

A test was carried out using an electrolytic cell having the following specifications under the following running conditions. As a result, electrolysis could be accomplished at such a considerably low voltage as 2.03 V. Dimensions of reaction plane: 600 mm by 1200 mm (reaction area: 72 $dm^2$)
Anode: DSE, available from Permelec Electrode Ltd.
Cathode: gas diffusion electrodes
Ion-exchange membrane: Flemion 893, available from Asahi Glass Co., Ltd.
Electrolytic current density: 30 $A/dm^2$
Running temperature: 90° C.
Caustic concentration: 32 wt % NaOH
Brine concentration: 210 g-NaCl/liter

INDUSTRIAL APPLICABILITY

According to the electricity leading method of the present invention, the above-described conductor which is exposed from the outer periphery of the gas diffusion electrode is bent at the outer periphery and meets an exposed and similarly bent edge of the conductor of an adjacent gas diffusion electrode in a gap between the adjacent gas diffusion electrodes. The two bent edges of the conductors are (1) overlapped and welded together or (2) inserted into a groove formed of the cathode current collecting frame at a prescribed position and wedged, whereby the conductors are fixedly brought into contact with the inner wall of the cathode current collecting frame. Therefore, the electrical resistance of the contact part is reduced, resulting in a remarkable reduction of electrolytic voltage.

Further, when the electrode is renewed, only the gas diffusion electrode can be replaced with a new one by cutting and removing the outer peripheral exposed conductor of the gas diffusion electrode. Therefore, the method of the invention is extremely superior to the conventional method of attaching a gas diffusion electrode and of leading electricity from the economical viewpoint.

According to the electricity conduction structure of the invention, electrical resistance of the cathode current collecting frame and the cathode chamber frame is reduced to greatly decrease the electrolytic voltage, and assembly and disassembly can be carried out with ease. In renewing the electrode, because only the gas diffusion electrode can be replaced, the method of the invention is extremely superior in economy to the conventional method of attaching a gas diffusion electrode and of leading electricity.

What is claimed is:

1. A gas diffusion electrode assembly comprising:

at least one gas diffusion electrode having a conductor sandwiched between an upper catalyst layer and a lower catalyst layer, the conductor having an exposed part which extends out from an end of the upper and lower catalyst layers; and a cathode chamber current collecting frame electrically connected to the exposed part of the at least one gas diffusion electrode at an electrical connection point.

2. The assembly of claim 1, wherein the conductor is a metallic mesh or a sponge material.

3. The assembly of claim 1, wherein the gas diffusion electrode is welded to the cathode current collecting frame at the electrical connection point.

4. The assembly of claim 1, further comprising:

plural of the gas diffusion electrodes;

a gap located between two corresponding ends of two of the plural gas diffusion electrodes, the corresponding exposed parts of the gas diffusion electrodes being welded together; and a sealant filling the gap to form a caustic soda solution entry barrier.

5. The assembly of claim 1, wherein:

the cathode chamber current collecting frame comprises, at the electrical connection point, a groove projecting away from the gas diffusion electrode;

the exposed part of the gas diffusion electrode is inserted into the groove; and a wedge is inserted into the groove on a top of the exposed part of the gas diffusion electrode.

6. The assembly of claim 4, wherein the sealant comprises the same material as the catalyst layers.

7. An electric leading structure comprising:

a cathode current collecting frame with a recess located on a first face;

a planar gas diffusion electrode resting in the recess; and a conducting rib attached to a second face of the cathode current collecting frame and projecting away from the gas diffusion electrode.

8. The structure of claim 7, further comprising:

a cathode chamber frame which is conductive and includes a receptacle made of copper or brass; and wherein the receptacle is mated with the conducting rib.

9. The structure of claim 8, further comprising:

a current collecting mesh located intermediate the gas diffusion electrode resting in the recess and the first face of the gas diffusion electrode; and wherein the gas diffusion electrode and the current collecting mesh non-permanently rest in the recess.

10. A method of leading electricity from a gas diffusion electrode assembly comprising to steps of:

providing an electric leading path through a catalyst by forming at least one gas diffusion electrode with a conductor sandwiched between an upper catalyst layer and a lower catalyst layer, the conductor having an exposed part which extends out from an end of the upper and lower catalyst layers; and extending the electric leading path to a cathode chamber current collecting frame electrically by connecting the exposed part of the at least one gas diffusion electrode at an electrical connection point of the current collecting frame.

11. The method of claim 10, by providing a conductor from a metallic mesh or a sponge material.

12. The method of claim 10, comprising the step of welding the gas diffusion electrode to the cathode current collecting frame at the electrical connection point by using a metallic cover material to avoid damaging the conductor during welding.

13. The method of claim 10, comprising the further steps of:

providing plural of the gas diffusion electrodes;

forming a gap located between two corresponding ends of two of the plural gas diffusion electrodes;

welding together the corresponding exposed parts of the gas diffusion electrodes; and filling the gap with a sealant to form a caustic soda solution entry barrier.

14. The method of claim 13, using the same material for the catalysts and sealant.

15. The method of claim 10, wherein:

the cathode chamber current collecting frame is provided with, at the electrical connection point, a groove projecting away from the gas diffusion electrode;

the exposed part of the gas diffusion electrode is inserted into the groove; and a wedge is inserted into the groove on a top of the exposed part of the gas diffusion electrode.

16. The method of claim 10 comprising the further steps of:

forming a recess located on a first face of the cathode current collecting frame;

resting in the recess a sized gas diffusion electrode; and attaching a conducting rib to a second face of the cathode current collecting frame, the conducting rib projecting away from the sized gas diffusion electrode.

17. The method of claim 16, further comprising the steps of:

providing a cathode chamber frame with a receptacle made of copper or brass; and mating the receptacle with the conducting rib to complete the electric leading path to the cathode chamber frame.

18. The method of claim 17, further comprising the step of:

locating a current collecting mesh intermediate the sized gas diffusion electrode resting in the recess and the first face of the gas diffusion electrode; and wherein the gas diffusion electrode and the current collecting mesh non-permanently rest in the recess.

* * * * *